United States Patent [19]

Bresson

[11] Patent Number: 4,850,418

[45] Date of Patent: Jul. 25, 1989

[54] BRAKE RELEASE MECHANISM FOR MOTOR OPERATED ROLLER BLINDS AND SHUTTERS

[75] Inventor: René Bresson, Mantoche, France

[73] Assignee: Societe Industrielle Du Metal Usine (SIMU), Arc-les Gray, France

[21] Appl. No.: 155,589

[22] Filed: Feb. 12, 1988

[30] Foreign Application Priority Data

Mar. 13, 1987 [FR] France ..... 87 03702

[51] Int. Cl.[4] ..... E06B 9/204

[52] U.S. Cl. ..... 160/310

[58] Field of Search ..... 160/310, 311, 312; 74/625; 192/8 R, 7; 188/171, 173, 72.3, 72.1

[56] References Cited

U.S. PATENT DOCUMENTS

| | | | |
|---|---|---|---|
| 2,620,901 | 12/1952 | Stearns | 188/171 |
| 3,221,845 | 12/1965 | Hansen | 188/171 |
| 3,285,089 | 11/1966 | Tsugawa | 160/310 X |
| 3,665,231 | 5/1972 | Wendler | 188/171 X |
| 4,059,339 | 11/1977 | Brown | 160/310 X |
| 4,181,201 | 1/1980 | McCarthy | 188/171 |
| 4,417,185 | 11/1983 | Bullat | 160/310 X |

FOREIGN PATENT DOCUMENTS

| | | | |
|---|---|---|---|
| 2398174 | 3/1979 | France | 160/310 |

*Primary Examiner*—Ramon S. Britts
*Assistant Examiner*—David M. Purol
*Attorney, Agent, or Firm*—Dowell & Dowell

[57] ABSTRACT

A device for automatically releasing the braking mechanism of roller blinds or shutters or the like which are selectively operated by a motor drivingly connected to the drum of the blind wherein a drive shaft for the drum is prevented from rotating by gripping a brake disk between two rotating plates. Releasing of the brake is automatically effected as soon as the motor is activated by magnetic attraction of a yoke, which includes one of the rotating plates, against a spring element. In the event of an electrical failure, the brake may be released manually by mechanically urging the yoke from the brake disk against the action of the spring element.

6 Claims, 1 Drawing Sheet

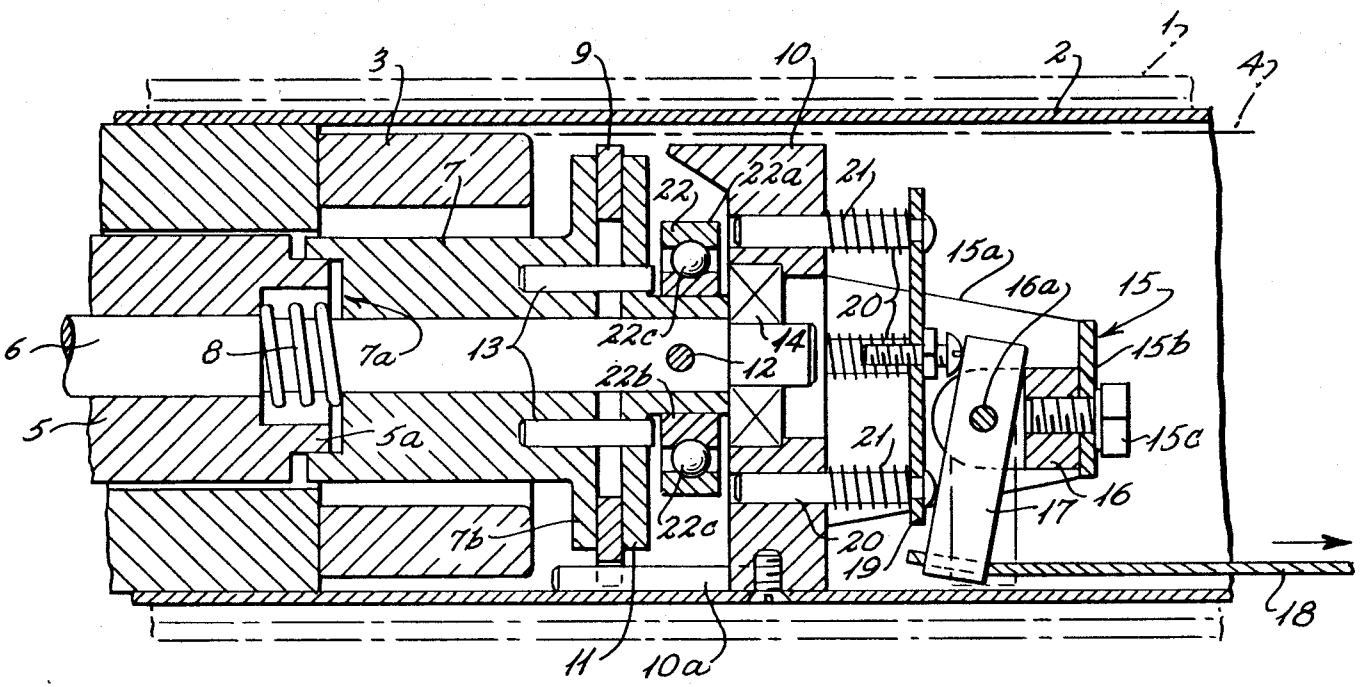
4
1
2
15
15b
15a
16
17
18
16a
15a
21
20
21
20
19
10
22a
14
12
22
22c
22b
22a
10a
9
11
13
7b
7
3
7a
5a
8
6
5

BRAKE RELEASE MECHANISM FOR MOTOR OPERATED ROLLER BLINDS AND SHUTTERS

BACKGROUND OF THE INVENTION

FIELD OF THE INVENTION

The present invention relates to roller blinds or shutters and other assemblies in which the supple closure member is wound on a drum which is driven in rotation by an electric motor and with which is associated a device adapted to ensure automatic braking thereof in order to immobilize the closure member as soon as the electric motor is deenergized.

SUMMARY OF THE INVENTION

It is an object of the invention to produce an automatic braking device of the above type which, despite a mechanical construction which is simplified with respect to conventional techniques, proves to be remarkably efficient as far as the braking is concerned.

It is another object of the invention to provide the device with an unblocking system which is capable of being easily manoeuvred by hand in the event of an electrical failure.

The device according to the invention is characterized in that it comprises a brake disc which is retained from rotation in a fixed frame while being free to move axially therein. Two rotating plates are applied against the opposite faces of the brake disk of which one is carried by a yoke adapted, by magnetic attraction, to move axially against an elastic means as soon as the electric motor is operated while the other receives, through an appropriately arranged intermediate roller bearing, the manual control mechanism.

BRIEF DESCRIPTION OF THE DRAWINGS

The invention will be more readily understood on reading the following description with reference to the accompanying drawings, in which:

The single FIGURE is an axial section illustrating the arrangement of an automatic braking device according to the invention.

DESCRIPTION OF THE PREFERRED EMBODIMENT

Referring now to the drawing, it has been assumed that the cloth, shade or other closure member of the roller blind or shutter is wound on a drum 1 inside which is directly mounted a fixed tubular frame 2 which encloses the electric motor intended for driving the drum 1. This electric motor, which is capable of rotating in both directions, comprises a stator 3 which is supplied with electricity by conductors shown schematically at 4 and of which the stack of plates surrounds a rotor 5. The rotor is fitted on a shaft 6 oriented axially with respect to the fixed frame 2. The two ends of shaft 6 project on either side of the motor 3–5, and on one side drive a reducing mechanism (not shown) connected to the drum 1 and on the other side cooperate with the automatic braking device forming the subject matter of the invention.

On the end of the shaft 6 which extends to the braking device there is movably mounted a yoke 7 made of magnetic metal, whose end facing the direction of the rotor 5 is hollowed out with a cylindrical depression or recess 7*a* inside which is positioned an annular projection 5*a* provided on the rotor. In the free axial space thus formed between the yoke 7 and the rotor 5 there is housed a spring 8 which surrounds the shaft 6 and which tends to resiliently urge the yoke from the rotor.

Opposite the recess 7*a*, yoke 7 includes one end which is formed as a plate 7*b* which the spring 8 tends to urge against a disc 9 made of a material with a high coefficient of friction, which disc is prevented from rotating by at least one longitudinal pin 10*a* secured to a fixed crosspiece 10 added inside the frame 2 and secured thereto by a fastener 10*b*. The disc 9 is gripped between the plate 7*b* and an opposite plate 11 suitably secured to the shaft 6, for example with the aid of a pin 12. It will be observed that the plate 11 is freely traversed by longitudinal fingers or pins 13 which are secured inside openings made in the yoke 7.

The crosspiece 10 which contains one of the bearings 14 of the shaft 6, is secured to a stirrup element or bracket 15 which faces away from disc 9 and which supports a fork joint 16 and which is secured to the bracket by bolt 15*c* on a pin 16*a* on which pivots a small lever 17 capable of being remotely manoeuvred by hand with the aid of a cable 18 the bracket 15 includes side walls 15*a* and an end wall 15*b*. The lever 17. The end of lever 17 which faces the interior of the frame 2 is applied against the central part of a small bar 19 provided with pushers or pins 20 mounted to slide in perforations in the crosspiece 10. Spring 21 carried by the pushers 20 and abutting against the crosspiece 10, tend to push the bar 19 against the rocking lever 17.

The pushers 20 extend through the crosspiece 10 in order to bear against the outer ring 22*a* of a ball bearing 22, of the type with deep grooves 22*c*, of which the inner ring 22*b* slides and rotates on the hub 11*a* of the plate 11 connected to the shaft 6. Under these conditions, it will be readily appreciated that movement of the rocking lever 17 with the aid of cable 18 (whose free end is accessible outside the frame 2), provokes, by abutment of pushers 20 against the outer ring 22*a* of bearing 22, the axial displacement of the bearing which in turn causes the inner ring 22*b* to push the fingers 13 and the yoke 7 against the spring 8.

Operation and mode of use of the automatic braking device according to the invention follow from the foregoing explanations and will be readily understood.

When the electric motor 3–5 is not energized, the spring 8 pushes the yoke 7 axially in the direction of disc 9 which is consequently gripped between the two plates 7*b* and 11. It will be noted that the braking effect obtained is very powerful since it is simultaneously exerted on the two opposite faces of the disc 9.

As soon as motor 3–5 is activated, the yoke 7 is axially attracted by the magnetic flux, against the spring 8 which is compressed. The plates 7*b* and 11 are therefore no longer applied against the disc 9, so that the shaft 6 is free to rotate to drive the drum 1 in one direction or the other. Under the effect of spring 8, this freedom or rotation ceases as soon as the motor is no longer operating, which results in the drum 1 and the closure member (cloth or the like) associated therewith being automatically secured in position.

If the user wishes to manoeuvre the roller blind or shutter manually such as when the motor 3–5 cannot be operated, is suffices to pull on the cable 18 in order to displace the yoke 7 axially against the spring 8 and thus release the drum 1.

It goes without saying that the number of fingers 13, pushers 20 and pins 10*a* may vary to a wide extent.

What is claimed is:

1. An apparatus for automatically releasing the brake associated with closures such as roller blinds and shutters wherein the closures include a generally cylindrical drum around which is supported a closure member which includes a motor mounted within the drum for selectively rotating the drum to adjust the displacement of the closure member relative thereto, comprising a frame member disposed within the drum, a brake means mounted within said frame member and having opposing faces, the motor being mounted within said frame and including a rotor, a drive shaft driven by said rotor and a stator extending from said rotor toward said brake means, said drive shaft extending from the rotor and through said brake means, a yoke member mounted within said frame member intermediate said rotor and said brake means and having first and second ends, said yoke means being disposed about said drive shaft and being slideable with respect thereto, said first end of said yoke means being disposed adjacent said stator and in opposing relationship to said rotor, a resilient means for normally urging said yoke means from the motor so that said second end of said yoke means is engaged with one of said opposing faces of said brake means, said yoke means being formed of a metal material so as to be urged toward said motor by magnetic attraction when the motor is ativated to thereby cause said second end thereof to be urged from engagement with said one face of said brake means, a manual brake release means mounted within said frame member, said manual brake release means including a plate means disposed adjacent the other of said opposing faces of said brake means, at least one first pin means slideably guided by said plate means and extending through said brake means and into engagement with said yoke means, and a slideable bearing means for selectively engaging said at least one first pin means to thereby urge said yoke means from engagement with said brake means.

2. The braking apparatus of claim 1 in which said plate means includes a central hub which is fixed to said drive shaft, said slideable bearing means being carried by said central hub of said plate means, said at least one first pin means being secured to said yoke means and having an outer end portion extending through at least one opening in said plate means, said slideable bearing means including inner and outer rings, and means for urging said slideable bearing means against said outer end portion of said at least one first pin means to thereby urge said yoke means toward said motor against said resilient means.

3. The braking apparatus of claim 2 wherein said manual brake release means includes at least one pusher element which is slideably carried by a fixed cross piece mounted within said frame member, said at least one pusher element having an outer end portion which is selectively engageable with said slideable bearing means, resilient means for normally urging said at least one pusher element from engagement with said slideable bearing means, and lever means for urging said at least one pusher element through said cross piece and into engagement with said slideable bearing means so as to selectively urge said yoke member from engagement with said brake means.

4. The braking apparatus of claim 3 including a bracket means carried by said cross piece member, said lever means being pivotally mounted to said bracket member, said at least one pusher element having an inner end portion which is carried by a plate member, said plate member being selectively movable by said lever means, and cable means connected to said lever means and extending from said frame member for manually operating said lever means.

5. The braking apparatus of claim 2 in which said movable pusher element selectively engages the outer ring of said slideable bearing means and said at least one first pin means is selectively engageable with said inner ring thereof.

6. The braking apparatus of claim 2 in which said brake means is retained in nonrotational relationship with respect to said frame member by at least one second pin means which is carried by said cross piece member.

* * * * *